United States Patent [19]

Matsuoka

[11] Patent Number: 4,838,230

[45] Date of Patent: Jun. 13, 1989

[54] FUEL INJECTION CONTROL SYSTEM FOR INTERNAL COMBUSTION ENGINE WHEN STARTING

[75] Inventor: Hiroki Matsuoka, Susono, Japan

[73] Assignee: Toyota Jidosha Kabushiki Kaisha, Aichi, Japan

[21] Appl. No.: 173,660

[22] Filed: Mar. 25, 1988

[30] Foreign Application Priority Data

Apr. 6, 1987 [JP] Japan ..... 62-84451

[51] Int. Cl.[4] ..... F02M 39/00

[52] U.S. Cl. ..... 123/491; 123/179 L

[58] Field of Search ..... 123/179 L, 179 G, 491, 123/494, 357, 358, 359

[56] References Cited

U.S. PATENT DOCUMENTS

| | | | |
|---|---|---|---|
| 4,516,550 | 5/1985 | Buck | 123/179 L |
| 4,653,452 | 3/1987 | Sawada | 123/491 |
| 4,681,079 | 7/1987 | Kaneta | 123/491 |
| 4,705,004 | 11/1987 | Takahashi | 123/179 L |
| 4,712,522 | 12/1987 | Anzai | 123/179 L |
| 4,739,741 | 4/1988 | Iwata | 123/491 |
| 4,751,909 | 6/1988 | Otobe | 123/491 |

FOREIGN PATENT DOCUMENTS

| | | | |
|---|---|---|---|
| 61-215428 | 9/1961 | Japan | 123/179 L |

*Primary Examiner*—Carl Stuart Miller

*Attorney, Agent, or Firm*—Kenyon & Kenyon

[57] ABSTRACT

A fuel injection control system for an internal combustion engine achieves efficient combustion during starting the engine and reduces excess fuel consumption. While the engine has not warmed yet after starting, extra fuel is supplied to the engine by a starting fuel supply means. When the engine rotational speed exceeds a predetermined first speed corresponding to an almost complete combustion state, the fuel injection amount from the starting fuel supply means is gradually decreased. When the engine rotational speed is determined to exceed a predetermined second speed corresponding to a stable combustion state, the extra fuel from the starting fuel supply means is terminated, and the fuel injection amount based on the engine start control is changed over to the amount based on an air-fuel ratio control for post-starting state.

7 Claims, 7 Drawing Sheets

FUEL INJECTION CONTROL SYSTEM FOR INTERNAL COMBUSTION ENGINE WHEN STARTING

BACKGROUND OF THE INVENTION

1.Field of the Invention

This invention relates to a fuel injection system for an internal combustion engine for controlling a fuel amount to be supplied to a combustion chamber so that optimum combustion conditions can be obtained, especially when starting the engine.

2. Prior Art

Various types of fuel injection systems have been proposed for realizing stable starting of an internal combustion engine before the engine has been warmed up. One example is an electronic fuel injection system disclosed in Japanese laid open patent publication No. 61-215428. In this prior art, when the internal combustion engine starts, the fuel injection is controlled so that a preset amount of fuel, being larger than the amount to be supplied after complete combustion occurs, is, constantly supplied until the rotational speed of the engine reaches a predetermined value. After the rotational speed of the engine reaches the predetermined value, the fuel injection amount to be injected is gradually decreased to approach an amount which is determined based on an air-fuel ratio control for post-start state as shown by a single-dash broken line I in FIGS. 8 and 9.

If the increased amount of fuel for starting the engine is constantly supplied for a long time, the rotational speed of the engine may increase more than expected, resulting in deteriorating fuel economy, as indicated by the double-dash broken line IIA in FIGS. 8 and 9. If the environmental temperature of the engine is extremely low, the rotational speed of engine may not reach the target rotational speed corresponding to the complete combustion state. As a result, the air-fuel ratio becomes "over rich", which is apt to deteriorate the starting efficiency of the engine. This condition is indicated by the broken line IIB in FIGS. 8 and 9. On the other hand, if the fuel injection amount is suddenly changed from the amount based on an engine start control to that based on an air-fuel ratio control for post-start state before the rotational speed of the engine reaches the target rotational speed corresponding to stable combustion, the fuel supply amount may become insufficient. As a result, the rotational speed of the engine is suddenly decreased as shown by a broken line III in FIGS. 8 and 9, and so-called engine stall may happen.

The above-mentioned prior art fuel injection system (No. 61-215428) has solved those problems. However, it still includes other problems as follows. As described above, the fixed fuel injection amount during starting the engine is gradually decreased to an amount determined by the air-fuel ratio control for post-start state. Since the fuel injection amount determined by the air-fuel ratio for post-start state varies, the excess of fuel injection amount over the amount determined by the air-fuel ratio for post-start state changes during a period from time point T1, at which the complete combustion condition is about to start, to time point T2, at which the air-fuel ratio control is started. For example, if the fuel injection amount during idling under the complete combustion condition is small, the excess fuel amount to be supplied during the period of decreasing the fuel injection amount (shown by the shaded portion in FIG. 8) may exceed a required amount. As a result, the air-fuel ratio becomes "over rich" before the fuel injection amount based on the engine start control is changed over to the amount based on the air-fuel ratio control, for post-start state. Under such a condition, not only is the fuel wasted but also hydrocarbon (HC) contained in the exhaust gas increases.

SUMMARY OF THE INVENTION

Accordingly, it is an object of the present invention to solve the above-mentioned problems and to provide a fuel injection system for an internal combustion engine in which the fuel injection amount is ideally controlled during starting of the engine.

To achieve this and other objects, an apparatus according to the present invention is generally constituted as follows. Namely, as shown in FIG. 1, a fuel injection system for an internal combustion engine M1 includes:

starting fuel supply means M2 for supplying an amount of fuel to the engine M1, the amount being determined exclusively for a starting state of the engine M1;

post-starting fuel supply means M7 for supplying another amount of fuel to the engine M1, said another amount being determined based on an air-fuel ratio control;

first determination means M3 for determining whether a rotational speed of the engine M1 exceeds a first predetermined speed, the first predetermined speed corresponding to a rotational speed of the engine M1 at which complete combustion starts in a combustion chamber of the engine M1;

fuel decreasing means M4 for gradually decreasing the amount of fuel to be supplied to the engine M1 by the starting fuel supply means M2 when the first determination means M3 determines that the rotational speed of the engine M1 exceeds the first predetermined speed;

second determination means M5 for determining whether the rotational speed of the engine M1 exceeds a second predetermined speed, the second predetermined speed being greater than the first predetermined speed and corresponding to an engine speed at which stable running of the engine M1 occurs after the starting state; and fuel supply switching means M6 for switching from fuel supply by the starting fuel supplying means M2 to fuel supply by the post-starting fuel supply means M7 when the second determination means M5 determines that the rotational speed of the engine M1 exceeds the second predetermined state.

The starting fuel supply means M2 supplies a fixed amount of fuel or a certain amount of fuel responsive to a coolant temperature of the engine M1. For example, it is embodied by a cold start injector provided on a surge tank or by utilizing a fuel injection valve provided on each cylinder.

The post-starting fuel supply means M7 supplies fuel to the engine M1 based on an air-fuel ratio control.

The first determination means M3 determines whether the rotational speed of the engine has reached a first speed at which an almost complete combustion starts after cranking. It is realized by a sensor for outputting signals when the engine rotational speed exceeds a predetermined speed or an arithmetic and logic circuit with a sensor for outputting pulse signals responsive to the rotation of a crankshaft of the engine M1. The first speed may be a fixed value or a variable responsive to the coolant temperature of the internal combustion engine M1.

The fuel decreasing means M4 may be one which decreases fuel supply by a predetermined amount every preset time interval or one which decreases fuel supply by a certain amount responsive to the change in the rotational speed of the engine M1 every preset time interval, when the first determination means M3 determines that the rotational speed of the internal combustion engine M1 has reached the first speed. The fuel decreasing means M4 can be embodied in combination with the first determination means M3.

The second determination means M5 determines whether the rotational speed of the engine exceeds the second speed at which stable rotation of the engine M1 starts. The second speed naturally is higher than the first speed. It may be embodied by a sensor for outputting signals when the engine rotational speed exceeds the second speed or by an arithmetic and logical circuit including a rotational speed sensor for outputting pulse signals responsive to the rotation of the crankshaft of the engine M1. The second determination means M5 and the first determination means M3 may have a common rotational speed sensor. The second speed may be a fixed value or a variable responsive to the coolant temperature of the engine M1.

The fuel supply switching means M6 switches over from fuel supply by the starting fuel supply means M2 to fuel supply by the post-starting fuel supply means M7 when the rotational speed of the engine exceeds the second speed. It may be embodied by an arithmetic and logical circuit.

BRIEF DESCRIPTION OF THE DRAWINGS

By way of example and to make the description clearer, reference is made to the accompanying drawings in which.

DETAILED DESCRIPTION OF PREFERRED EMBODIMENT

A preferred embodiment of the present invention is set forth with reference to the attached drawings.

Figure 1:
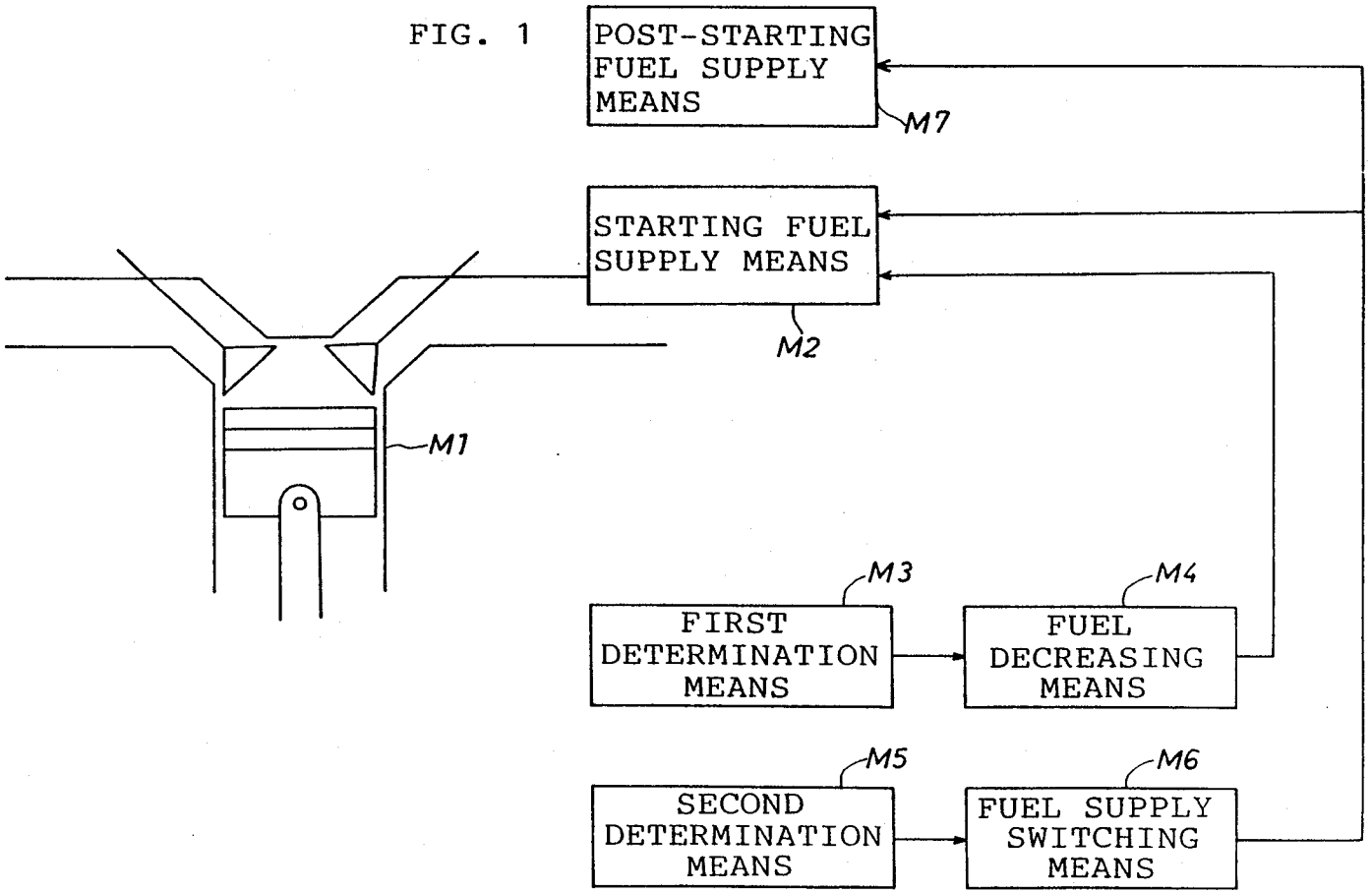
FIG. 1 is a block diagram showing a fundamental structure of a fuel injection system for an internal combustion engine of the present invention.
Figure 2:
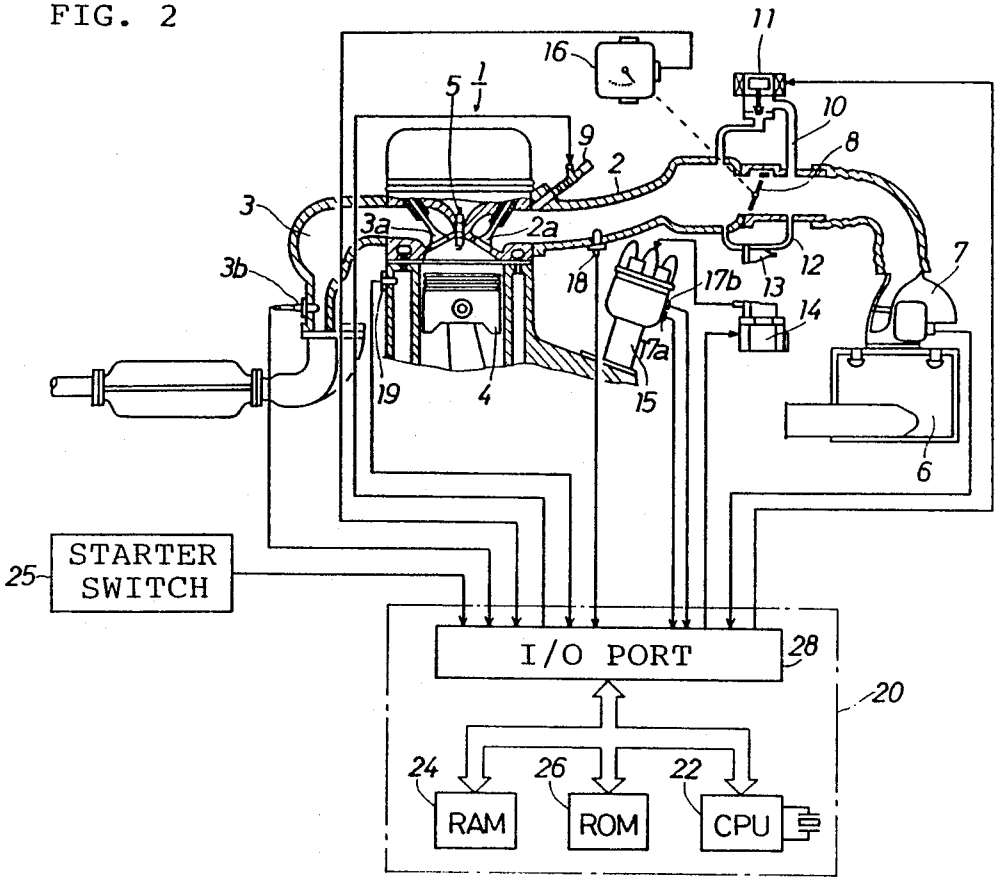
FIG. 2 is a schematic view illustrating the internal combustion engine and its peripheral equipment including a control unit.

As shown in FIG. 2, a four-stroke cycle internal combustion engine 1 includes an intake pipe 2 and an exhaust pipe 3 for each cylinder. A combustion chamber of the engine 1, the volume of which changes according to the action of a piston 4, is equipped with a spark plug 5, an intake valve 2a and an exhaust valve 3a. The intake pipe 2 is provided with an air cleaner 6 for cleaning the intake air, an airflow meter 7 for measuring the intake air amount, a throttle valve 8 for controlling the intake air amount, and an electromagnetic fuel injection valve 9. The intake pipe 2 further includes an air path 10 for bypassing the throttle valve 8, an idle speed control valve (ISC valve) 11 for controlling the idle rotational speed by controlling the flow of the air path 10, an auxiliary air path for fast idle 12 for bypassing the throttle valve 8 when the engine 1 has not warmed yet, and an air valve 13 for controlling the flow of the auxiliary air path 12. A distributor 15, driven by a crankshaft (not shown), distributes high voltage generated by an ignition device 14 to an ignition plug 5 of each cylinder.

In order to accurately sense the working condition of the engine 1, the engine 1 is equipped with various sensors: a throttle position sensor 16 for outputting signals corresponding to the opening of the throttle valve 8; rotational speed sensors 17a and 17b installed in the distributor 15 for outputting signals so as to determine the crank angle and the firing cylinder; an intake air temperature sensor 18 for sensing the temperature of the intake air; a coolant temperature sensor 19 for sensing a coolant temperature THW of the engine 1; and an oxygen sensor 3b installed in the exhaust pipe 3 for sensing the relative proportion of the residual oxygen in the exhaust gas. These sensors are all connected with an electronic control unit (ECU) 20. The ECU 20 includes CPU 22, RAM 24, ROM 26 and an input/output (I/O) port 28. The I/O port 28 is connected with the injection valve 9, the ISC valve 11, the ignition switch 14 and the starter switch 25 besides the above-mentioned sensors. The ROM 26 stores various programs for ideally controlling the engine 1. Among those programs, a program for controlling the fuel injection during starting the engine 1 is explained in detail with reference to the flowcharts of FIGS. 3, 4 and 5.

Figure 3:
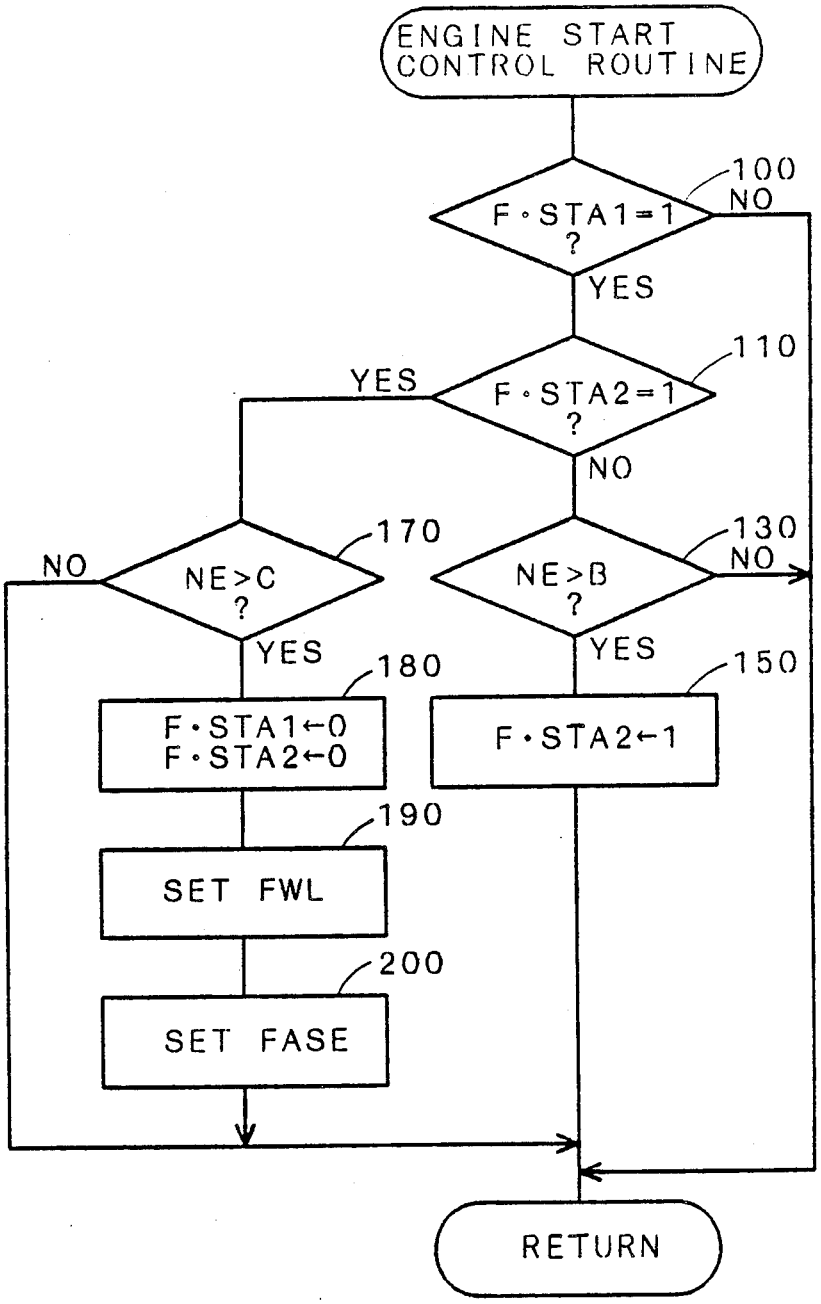
FIG. 3 is a flowchart of a starting control routine.

Set forth below is the explanation of the starting control routine based on FIG. 3. When power is supplied to the ECU 20 by a driver, the CPU 22 in the ECU 20 starts working, and initialization is executed. At this time, a first flag F·STA1 for indicating the start of the engine and a second flag F·STA2 for determining completion of the starting state, which are stored in the RAM 24, are cleared. The first flag F·STA1 is set when the starter switch 25 is switched on and the cranking is started. At the same time, variables STA1 and STA2 and an actual injection amount TAU stored in the RAM 24 are all cleared to 0. Thereafter, the present routine is repeatedly executed.

When cranking starts, the first flag F·STA1 is input in the CPU 22 so as to determine whether the flag F·STA1 is set. If the answer is NO, namely, when the starter switch 25 is OFF and the first flag F·STA1 has not been set, the program does not enter into the following step, and the present routine is concluded. If the answer is YES at step 100, the program proceeds to step 110, where it is determined whether the second flag F·STA2 is set. If the answer is YES, the program proceeds to step 170, while if NO, the program proceeds to step 130. At step 130, signals sent from the rotational speed sensors 17a and 17b are read out via the I/O port 28. Based on those signals, a rotational speed of the engine NE is calculated, and it is determined whether the rotational speed of the engine NE exceeds a first speed B (approx. 400 rpm) at which the engine 1 is near the complete combustion condition after cranking. If the answer is NO, cranking continues and the present routine is concluded. If the answer is YES, the second flag F·STA2 is set at step 150, and the present routine is concluded.

When it is determined at step 110 that the second flag F·STA2 is set, the program proceeds to step 170. At this step, it is determined whether the rotational speed of the engine NE exceeds a second speed C (approx. 700 rpm) at which the engine 1 is in the stable operating state. If the answer is NO, i.e., the rotational speed of the engine NE has not reached the second speed C, cranking continues and the present routine is concluded. If YES, i.e., the rotational speed of the engine exceeds the second speed C, the program proceeds to step 180 where the first flag F·STA1 and the second flag F·STA2 are cleared. At subsequent step 190, the coolant temperature THW is sensed by the coolant temperature sensor 19. Based on the temperature THW, an increase coefficient for warming FWL to be used in a fuel injection timing control routine is set. At step 200, an increase coefficient for after starting FASE is set, and the present routine is concluded.

In the case that the rotational speed of the engine is stabilized and the flags F·STA1 and F·STA2 are reset, the flags are never set thereafter even though the present routine is repeated.

Figure 4:
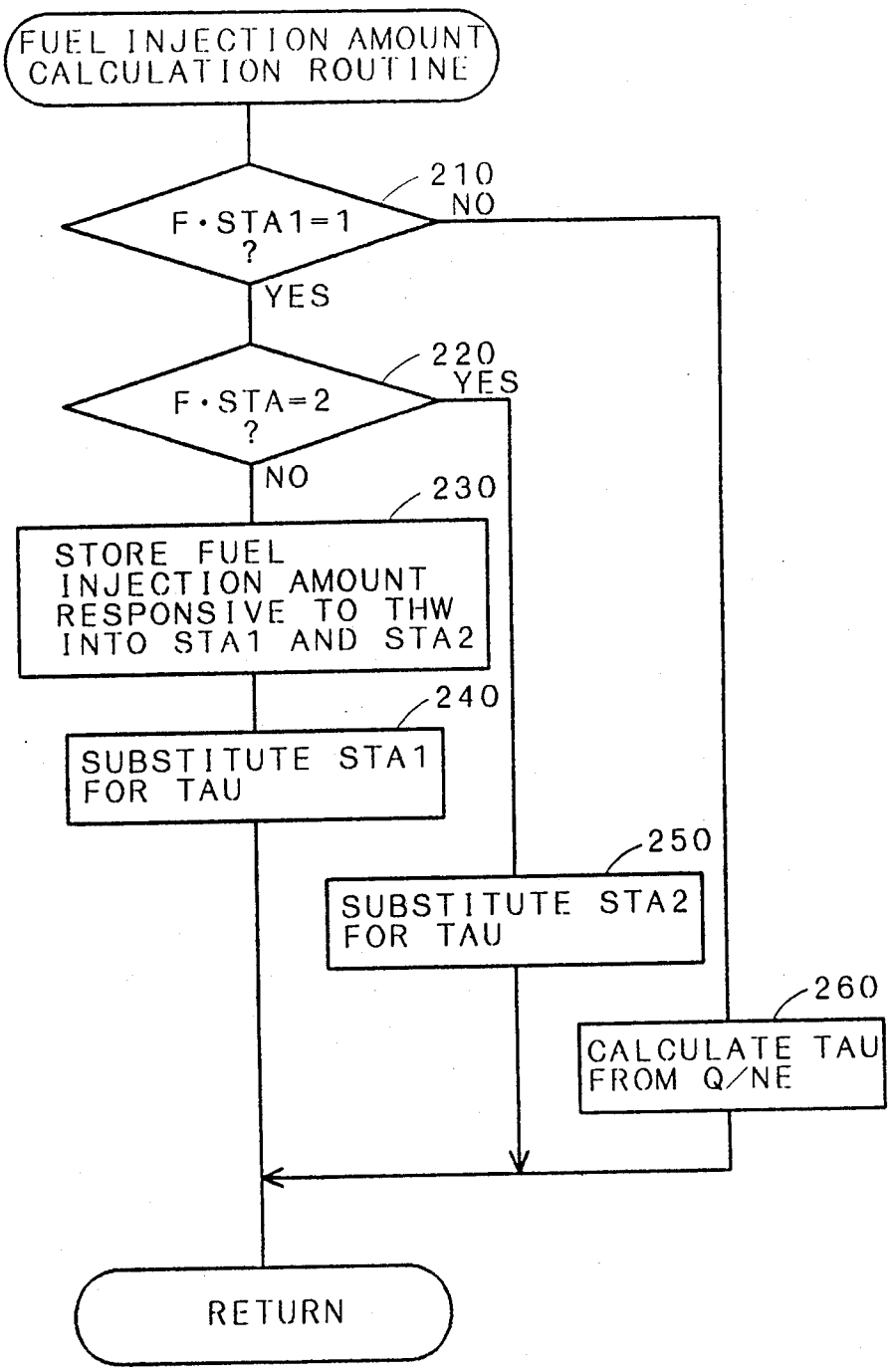
FIG. 4 is a flowchart showing a fuel injection amount calculation routine.

The following explains the fuel injection amount calculation routine with reference to the flowchart of FIG. 4 in which the fuel injection amount responsive to the condition of the first flag F·STA1 and the second flag F·STA2 is calculated.

Figure 6:
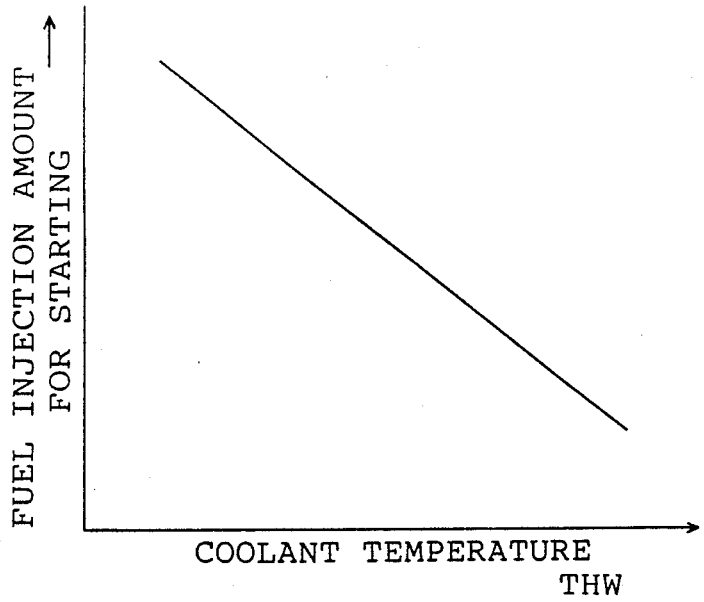
FIG. 6 is a map for indicating a change in a fixed fuel injection amount during starting the engine in relation to a coolant temperature THW.

At step 210, it is determined whether the first flag F·STA1 is set. If the answer is YES, the program proceeds to step 220 at which it is determined whether the second flag F·STA2 is set. If the answer is NO at step 220, namely, the engine is under the initial starting condition, the program proceeds to step 230. At this step, the coolant temperature THW of the engine 1 is sensed by the coolant temperature sensor 19. Then, the fuel injection amount corresponding to the temperature THW is determined based on a map shown in FIG. 6 stored in the ROM 26. At step 230, the calculated fuel injection amount is stored in variables STA1 and STA2 in the RAM 24. At subsequent step 240, the fuel injection amount stored in the variable STA1 is substituted for the actual fuel injection amount TAU. Then, the present routine is concluded. The actual fuel injection amount TAU is utilized for fuel injection in the fuel injection timing control routine.

On the other hand, if it is determined at step 220 that the second flag F·STA2 is set, namely, the rotational speed of the engine NE is determined to exceed the first speed B, the program proceeds to step 250 at which the fuel injection amount stored in the variable STA2 is substituted for the actual fuel injection amount TAU. Then, the present routine is concluded. The actual fuel injection amount TAU obtained at step 250 is also utilized in the execution of fuel injection as in the case of step 240. However, since the variable STA2 is gradually decreased by an interruption routine (described later) which is executed every predetermined time interval (approx. 16 msec), the actual fuel injection amount TAU is also decreased.

When it is determined at step 210 that the first flag F·STA1 is reset, i.e., when the rotational speed of the engine NE is determined to exceed the second speed C, the program proceeds to step 260. At this step, a known L-Jetronic air-fuel ratio control is started as in the normal driving condition. Namely, an intake air amount Q is detected by the air-flow meter 7 and the fuel injection amount is calculated based on the division Q/NE of the intake air amount Q by the rotational speed of the engine NE. The calculated fuel injection amount is stored in the actual fuel injection amount TAU.

Figure 5:
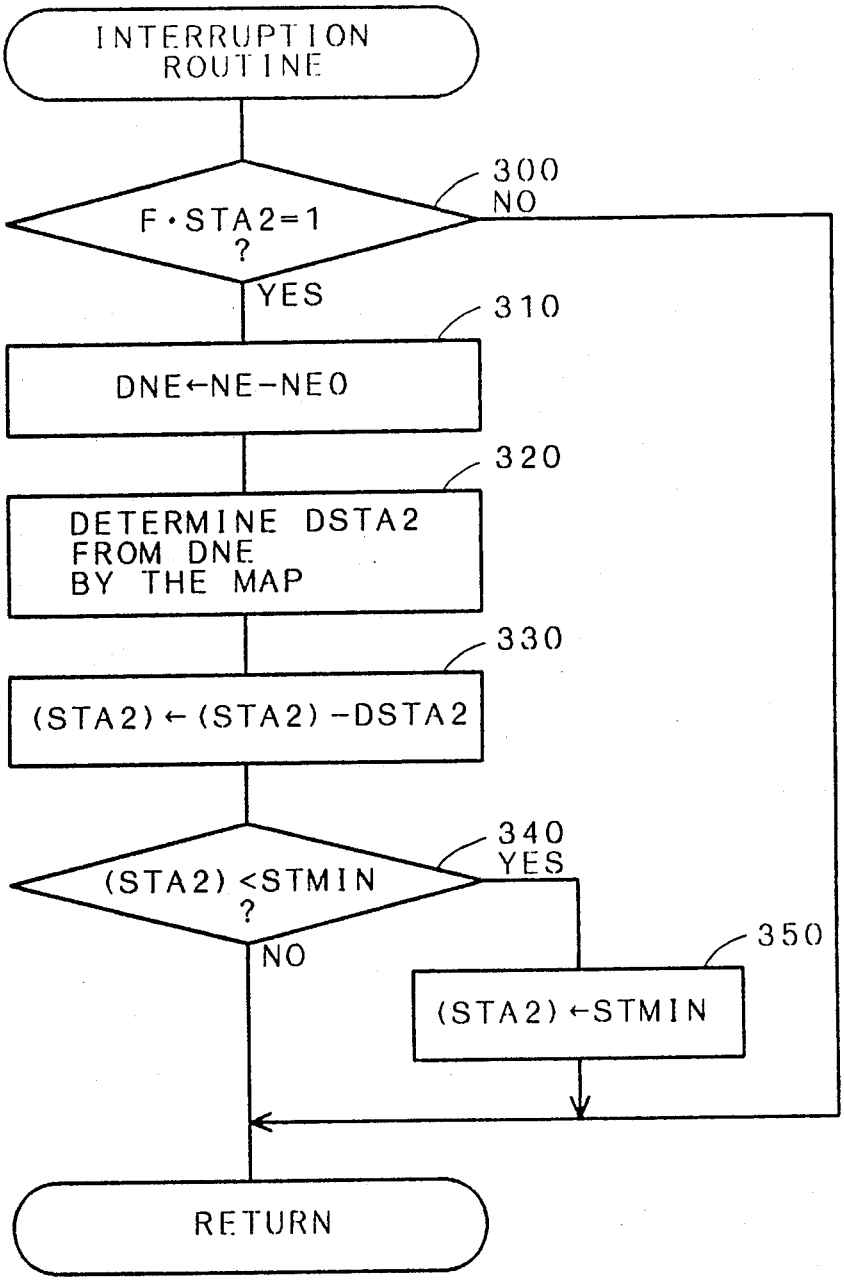
FIG. 5 is a flowchart of an interruption processing routine.
Figure 7:
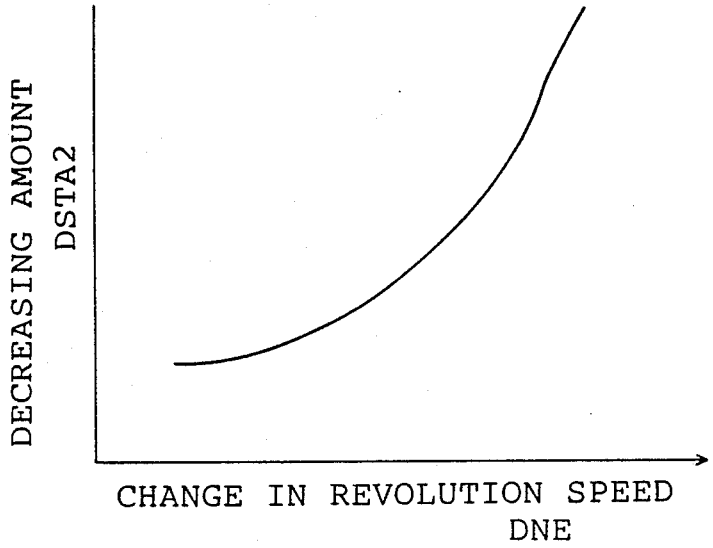
FIG. 7 is a map showing a characteristic curve of a decreasing amount of fuel DSTA2 in relation to the change DNE in the rotational speed of the engine.

Set forth is the explanation of the interruption routine based on the flowchart of FIG. 5. The interruption routine is executed by the CPU 22 approximately every 16 msec so that the variable STA2 is gradually decreased when the second flag F·STA2 is set. At step 300, it is first determined whether the second flag F·STA2 is set. If the answer is NO, the following process steps are never executed and the present routine is concluded. If the answer is YES at step 300, the program proceeds to step 310 at which a difference DNE between the rotational speed of the engine NE in the present interruption obtained by the engine rotational speed sensors 17*a* and 17*b* and an engine rotational speed NE0 obtained in the preceding interruption is calculated. At subsequent step 320, a reduction DSTA2 responsive to the difference DNE is obtained based on a map of FIG. 7 previously stored in the ROM 26. Then, the program proceeds to step 330, at which the reduction DSTA2 is subtracted from the variable STA2. At step 340, it is determined whether the variable STA2 is lower than a predetermined minimum value STMIN. If the answer is NO, the variable STA2 is not changed. If the answer is YES at step 340, the predetermined minimum value STMIN is substituted for the variable STA2 at step 350, and the present routine is concluded.

Figure 8:
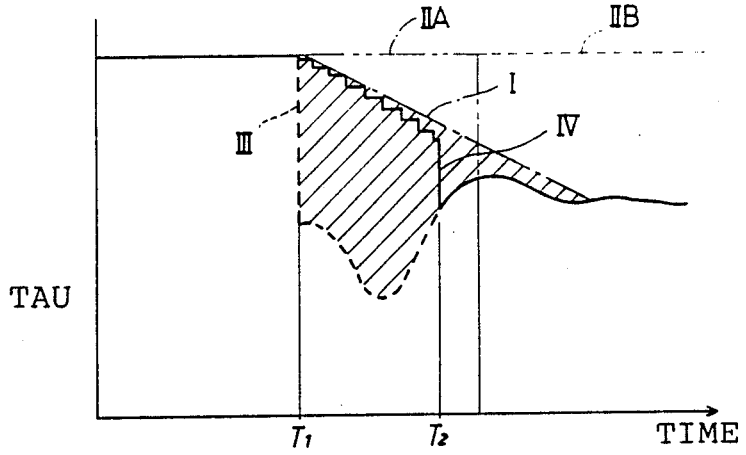
FIG. 8 is a graph showing the change in the fuel injection amount in relation to time.

By executing the engine start control routine, the fuel injection amount calculation routine, and the interruption routine as described above, a certain pattern of the fuel injection amount is obtained as shown by a line IV in FIG. 8. As will be understood from FIGS. 8 and 9, when the starter switch 25 is ON, a predetermined fuel amount responsive to the coolant temperature is supplied to the engine 1, while the rotational speed NE of the engine 1 is under a starting condition A. After the engine rotational speed NE reaches the first speed B (approx. 400 rpm) at a time point T1 corresponding to reaching the almost complete combustion condition, the fuel injection amount is gradually decreased in response to the change of the engine rotational speed NE. When the engine rotational speed reaches the second speed C (approx. 700 rpm) at a time point T2 corresponding to the stable rotational condition, the reduction of the fuel injection amount is terminated, and control of the fuel injection amount is transferred to the air-fuel ratio control for normal driving condition.

Figure 9:
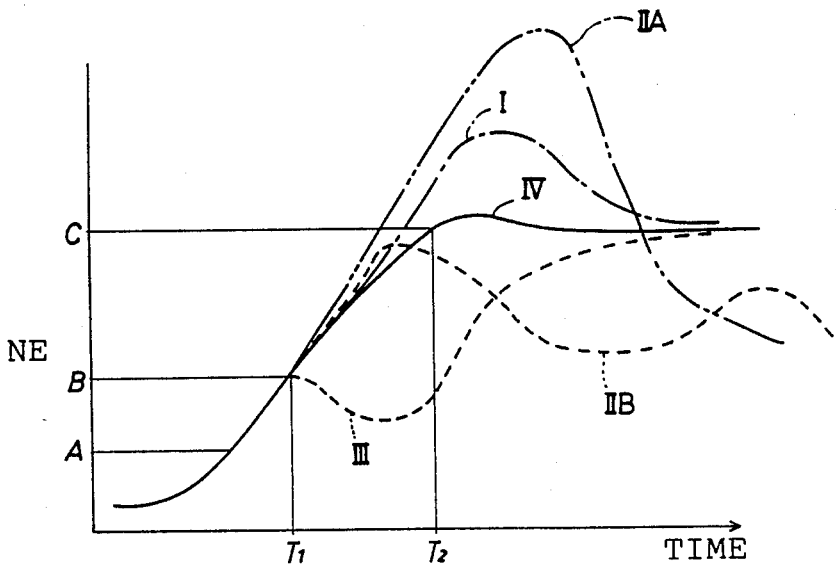
FIG. 9 is a graph showing the change in the rotational speed of the engine in relation to time.

As a result, the engine rotational speed NE shifts smoothly and appropriately from the starting condition to the normal operating condition as indicated by the curve IV in FIG. 9 without a sudden decrease in the rotational speed due to the "over lean" air-fuel ratio which is likely to cause the engine to stall, or a sudden increase due to the "over rich" condition.

In the fuel injection system of the present embodiment, the fuel injection is preferably controlled during starting the engine without introducing troubles such as engine stall or the "over rich" condition, so that the fuel injection amount based on the engine start control can be changed over to the amount based on the air-fuel ratio control for normal driving as early as possible. As a result, not only the waste of fuel can be eliminated but also the increase of hydrocarbon in the exhaust gas can be prevented.

While the invention has been particularly shown and described with reference to a preferred embodiment, it will be understood by those skilled in the art that various other changes in form and detail may be made without departing from the spirit and scope of the invention.

What is claimed is:

1. A fuel injection control system for an internal combustion engine comprising:

starting fuel supply means for supplying an amount of fuel to the engine, the amount being determined exclusively for a starting state of the engine;

post-starting fuel supply means for supplying another amount of fuel to the engine, said another amount being determined based on an air-fuel ratio control;

first determination means for determining whether a rotational speed of the engine exceeds a first predetermined speed, the first predetermined speed corresponding to a rotational speed of the engine at which complete combustion starts in a combustion chamber of the engine;

fuel decreasing means for gradually decreasing the amount of fuel to be supplied to the engine by the starting fuel supply means when the first determination means determines that the rotational speed of the engine exceeds the first predetermined speed;

second determination means for determining whether the rotational speed of the engine exceeds a second predetermined speed, the second predetermined speed being greater than the first predetermined speed and corresponding to an engine speed at which stable running of the engine occurs after the starting state; and fuel supply switching means for switching from fuel supply by the starting fuel supplying means to fuel supply by the post-starting fuel supply means when the second determination means determines that the rotational speed of the engine exceeds the second predetermined state.

2. The fuel injection control system according to claim 1 wherein the first predetermined speed and the second predetermined speed are fixed speeds.

3. The fuel injection control system according to claim 1 wherein the first predetermined speed and the second predetermined speed are variable speeds depending on a temperature of the coolant of the engine.

4. The fuel injection control system according to claim 2 wherein the amount of fuel supplied by the starting fuel supply means before the rotational speed of the engine is determined to exceed the first predetermined speed is a fixed amount.

5. The fuel injection control system according to claim 3 wherein the amount of fuel supplied by the starting fuel supply means before the rotational speed of the engine exceeds the first predetermined speed is a variable amount depending on the temperature of the coolant.

6. The fuel injection control system according to claim 5 wherein the fuel decreasing means decreases the amount of fuel supplied by the starting fuel supply means according to time elapsed after the rotational speed of the engine is determined to exceed the first predetermined speed.

7. The fuel injection control system according to claim 6 wherein the fuel decreasing means decreases the amount of fuel supplied by the starting fuel supply means further depending on a change in the rotational speed of the engine.

* * * * *